United States Patent [19]

Gebel et al.

[11] 4,369,603

[45] Jan. 25, 1983

[54] METHOD OF POSITIONING AND ROTATING WORKPIECE AND ARRANGEMENT IMPLEMENTING SAME

[76] Inventors: Iosif D. Gebel, Svetlanovsky prospekt, 35, kv. 94; Arkady A. Zykov, prospekt Smirnova, 15, kv. 51; Vladimir M. Lvov, Manchesterskaya, 16, kv. 58; Askold I. Nefedov, 2 Nikitinskaya ulitsa, 8, kv. 5; Viktor I. Parshikov, prospekt K. Marxa, 70, kv. 93; Marina Y. Starkina, prospekt Shvernika, 3, kv. 121; Mendel S. Klibanov, all of Leningrad, U.S.S.R.; Alexandr S. Ryss, deceased, late of Leningrad, U.S.S.R.; by Maria I. Ryss, legal representative, ulitsa Vavilovykh, 15, korpus 3, kv. 85, Leningrad, U.S.S.R.

[21] Appl. No.: 164,150

[22] Filed: Jun. 30, 1980

Related U.S. Application Data

[63] Continuation of Ser. No. 965,036, Nov. 30, 1978, abandoned.

[51] Int. Cl.[3] ..... B24B 41/06

[52] U.S. Cl. ..... 51/236; 51/103 GH; 51/291

[58] Field of Search ..... 51/236, 237, 103 GH, 51/291

[56] References Cited

U.S. PATENT DOCUMENTS 3,169,351 2/1965 Hannon ..... 51/103

FOREIGN PATENT DOCUMENTS 1946891 3/1971 Fed. Rep. of Germany .
1298560 12/1972 United Kingdom .
280262 3/1970 U.S.S.R. ..... 51/237 R
541651 3/1975 U.S.S.R. ..... 51/237 R

*Primary Examiner*—Harold D. Whitehead
*Attorney, Agent, or Firm*—Fleit & Jacobson

[57] ABSTRACT

A method for positioning and rotating a workpiece shaped like a body of rotation and having a plane face, comprising the following steps: positioning the workpiece on an axial and a radial supports; transmitting the torque from a rotary driving member to the workpiece due to the forces of friction developed therebetween; and feeding ultrasonic mechanical vibrations to at least one of the supports, said vibrations being fed to any one of the supports in the direction substantially parallel to or at an angle not exceeding 10 degrees with the line of contact between the workpiece and said support. An arrangement implementing this method comprises separate axial and radial supports, the radial support being constituted by two parts spaced apart through a certain angle and having the profile, in the working portion, congruent to the cylindrical profile of the workpiece surface. The arrangement is further provided with a frictional rotary driving member contacting with the workpiece to be machined, and with an electromechanical magnetostriction converter operating within the ultrasonic range and having a waveguide rigidly connected to both converter and support, mechanical vibrations being fed thereto.

22 Claims, 22 Drawing Figures

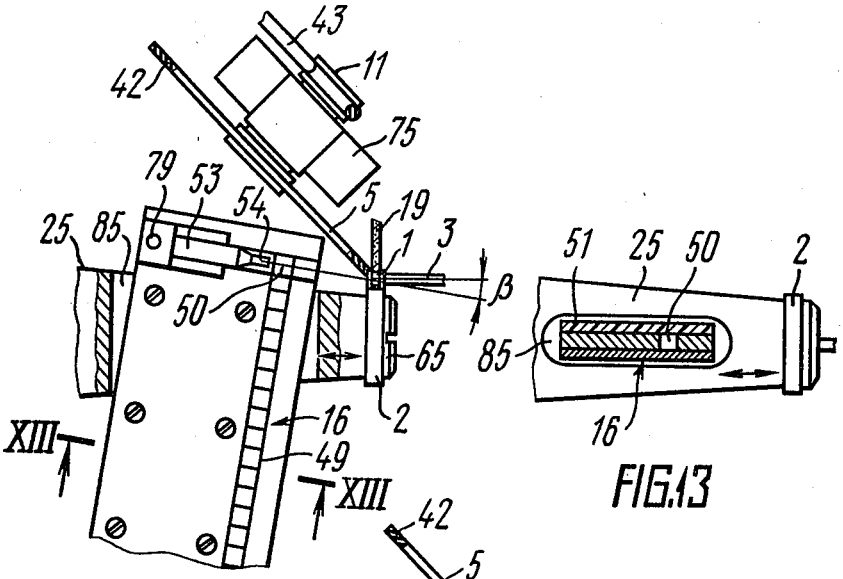
FIG.12
FIG.13
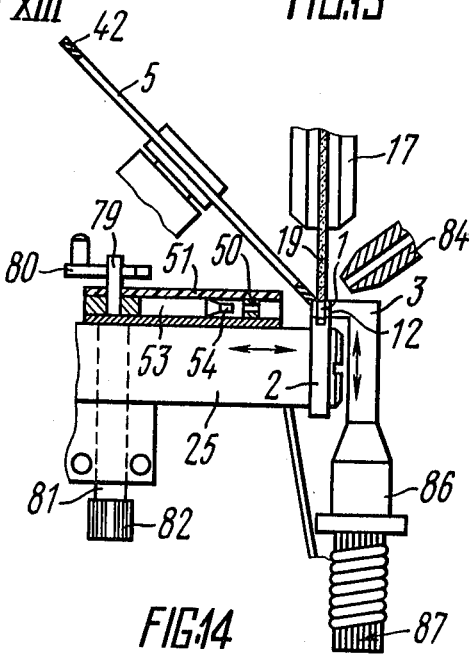
FIG.14

METHOD OF POSITIONING AND ROTATING WORKPIECE AND ARRANGEMENT IMPLEMENTING SAME

This is a continuation of application Ser. No. 965,036, filed Nov. 30, 1978, now abandoned.

The present invention relates to machine tools, and more particularly to methods for positioning and rotating disk-or-ring-shaped workpieces with plane faces and to arrangements implementing the same.

The invention can most advantageously be used for positioning and rotating race rings of the miniature or instrument rolling-element bearings during the centreless machining process, namely grinding and finishing, and also when controlling over workpiece dimensions and quality of machining. The invention is of particular interest for the machining of high or very high accuracy roller or ball bearing races.

As a circular workpiece shaped like a body of rotation with a plane face rotates, it is necessary to provide a reliable position thereof in the axial and radial directions and to transmit the torque thereto. It is also necessary to minimize the axial and radial wobbles of the workpiece caused by positioning and driving members to ensure a high accuracy of rotation of said workpiece, particular of the small workpiece, such as a rotor of a small-size device or miniature roller or ball bearing races. The radial and axial wobbles adversely affect the accuracy of workpiece rotation and, as a result the accuracy of machining the workpiece while being rotated with a high speed of the order from 5,000 to 15,000 r.p.m and more, such a speed being necessary to ensure the required workpiece finish. It is the force of friction developed between the workpiece and the positioning members that also adversely affects the accuracy of workpiece rotation.

It is a common knowledge that in order to rotate a circular workpiece having a plane face and positioned on fixed radial and axial supports, it is necessary that the torque (or its sum, in case of a plurality of driving members) rotating a workpiece be equal or over the total moment of all drags hindering the workpiece rotation, the frictional forces resulting from the fixed radial and axial supports constituting the bulk of the drags.

It is necessary to locate a circular workpiece on one axial support and on minimum two radial supports spaced apart through a certain angle for ensuring a reliable position thereof.

In this case, while the workpiece is being rotated by one driving member shaped like a friction roller contacting with the periphery of said workpiece, the torque is directly proportional to the force of the driving member pressure on the workpiece, to the coefficient of friction between the driving member and the workpiece, and to the workpiece radius. The total moment of the frictional forces is a function of the reactions of the fixed axial and radial supports, of the coefficients of friction between the workpiece and each of said supports, and also of the workpiece radius.

The angle between the radial supports spaced apart is formed by the vectors of reactions of said supports and is usually in the range from 75° to 160°, thus ensuring the most reliable positioning of the workpiece. If the radial supports are symmetric about the line of the driving member pressure, their reactions are equal and directly proportional to the driving member pressure and inversely proportional to the cosine of one-half the angle between the radial supports spaced apart. In this case, the total reaction of the fixed radial supports is found to be greater than the pressure of the driving member and, therefore, the moment of the frictional forces of the radial supports are greater than the torque of the driving member. As a result, when all coefficients of friction are equal, the workpiece fails to move, even without taking into account the moment of the axial support frictional force.

In the general case, therefore, in order to bring a workpiece into rotation, the torque of the driving member must be increased, while the total moment of the frictional forces of the supports should be reduced. One way of doing this is to increase the coefficient of friction developed between the workpiece and the driving member, and to decrease the coefficient of friction between the workpiece and the supports.

Known to the prior art is a method for positioning and rotating a workpiece shaped like a body of rotation with a plane face (cf. U.S. Pat. No. 3,169,351), which method resides in that a workpiece is positioned from a fixed plane axial support, and from combined radial supports, one of which is immovable and the other rotates serving as friction disk contacting with the outer peripheral surface of the workpiece. The workpiece is brought into rotation by the driving friction disk spring-loaded and also contacting with the outer peripheral surface of the workpiece. The friction disks press the workpiece against the fixed axial and radial supports, the axes of rotation of the friction disks being spaced through a certain angle relative to that of the workpiece, thus producing the component of the frictional force, pressing the workpiece with its plane face against the fixed axial support.

With such a method for positioning and rotating a circular workpiece, the torque transmitted thereto is determined from the total torque produced by the driving and rotary support disks, while the forces hindering workpiece rotation are generally determined from the total moment of the frictional forces of the fixed radial and axial supports. The workpiece is rotated by the torque exceeding the total moment of the frictional forces. With this method, such an exceeding is attained by an increase of the torque, while the moment of the frictional forces of the only one fixed radial support is reduced, when compared to the same values in the case of two fixed supports and one driving friction disk, that attained, in turn, by the normal pressure developed between the workpiece and the rotary driving member be greater than the normal pressure between the workpiece and fixed radial and axial supports.

With such a method, the accuracy of rotation of a workpiece is dependent upon:

the wobble of the operating surfaces of the rotary friction disks;

the state of the surface, namely its flatness and smoothness of the fixed axial support, being warn in time because of the friction developed between said surface and the workpiece while being rotated, that compels, to machine said surface particular carefully and to use the high rigid materials therefor, in order to reduce the friction therebetween, its adverse effects growing in time;

the position of the axial support surface the latter having to be perpendicular to the axis of rotation of the workpiece to be rotated.

According to this method, the wobbles of the operating surfaces of the rotary friction disks are determined by:

the axial and radial wobbles of the disks, unfailingly accompanied their rotation, which requires, with the aim of decreasing such wobbles, the axes of the rotary members used for positioning and rotating a workpiece to be mounted in precision bearings;

the uneven wear of the disks in diameter, eaused by an uneven intrinsic structure of the disk material and by the whole skeleton diagram used with such a method, wherein a workpiece is located between two rotary friction disks spaced apart. In this case, the effect of disk slipping gives rise to the scratch on the workpiece surface which also has the trimmer because of the driving disk is pressed against said workpiece with relatively large pressure. For the surface imperfections to be removed, it is required to use the additional surface treatment, thus increasing the laborious operations and giving rise to the workpiece rejects.

Moreover, with such a skeleton diagram, the rotary disks must be manufactured at high accuracy in diameter. In this case, the relationship between the rotary disk peripheral speeds must be strictly defined. Taken together these factors complecate the manufacture of the friction disks and their drive, and hamper the service and maintenance of the arrangement implementing said method.

Another disadvantage of such a diagram consists in that it is difficult to manufacture these disks since their working surfaces must be complex-shaped due to the fact that the axes of rotation of the driving and rotary support disks are turned through a certain angle relative to the axis of rotation of a workpiece to be machined.

Still another disadvantage of this diagram consists in that, in order to make the normal operation of the arrangement implementing this method, it is necessary to use, as lubricating cutting fluid stabilizing the workpiece rotation, various oils, such as spindle oil which is very expensive and, besides, harmful to the health of the staff.

Among the other disadvantages of this method using the driving disk and one immovable and one rotary radial supports, is that this method is suitable to machine, namely to grind the inner surfaces of the workpiece shaped like a ring, but fails to provide the machining of the workpiece outer surface which is almost inaccessible. Moreover, with this method, it is advantageous to grind a workpiece only in the zone opposite to the immovable support, that fails to make possible improving of the geometry of the machined surface relative to the base surface upon which the workpiece machining is carried out.

The disadvantages mentioned above limit the employment of this method, e.g. for positioning and rotating races of high and very high accuracy bearings.

Also known is the method for positioning and rotating a circular workpiece, residing in that a workpiece is positioned on immovable radial supports and on a rotary axial abutment serving as a driving member to rotate a workpiece. With this method, a workpiece may be held against the axial abutment with the aid of pressure rollers or a magnetic chuck and, against the radial supports by locating said abutment so that the axis of rotation of the workpiece is slightly displaced from that of the magnetic chuck.

The most serious disadvantage of said method consists in that during the machining process, namely grinding the wobble of the rotary axial abutment is transmitted to the workpiece, thus reducing the accuracy of its rotation, which, in turn, reduces the accuracy of machining. Because of this, such a method requires the head stock spindle, wherein the rotating axial abutment is fixed, to be mounted in precision bearings. When grinding the raceways of thrust bearings with a tolerance for the raceway non-parallelism relative to the position face being within 0.001 mm, the axial wobble of the spindle should not exceed 0.0005 mm. Such an accuracy is achieved through finishing by hand the support shoulder of the spindle and the axial bearing in the mandrel stock, i.e. by an extremely expensive and laborious operation. Besides, the spindle axial bearing is worn in time, which reduces the accuracy of rotation of the workpiece.

Moreover, the accuracy of rotation of a workpiece depends upon both magnitude and sense of the displacement of the axis of rotation of the workpiece relative to that of the magnetic chuck, thus complicating the operation of the arrangement implementing this method.

Among the other disadvantages, this method fails to reduce the rotational velocity of the drive, compared to that of the workpiece, which gives rise to an increased wear of the driving members, at required large rotational velocity of the workpiece, and also results in the wobbles and vibrations of the whole unit. It should be noted that it is impossible to position and rotate a workpiece made from nonmagnetic material in case that said workpiece is held against the axial abutment with the aid of the magnetic chuck.

There is known an arrangement implementing this method (cf. British Pat. No. 1,298,560 or FRG Pat. No. 1,946,891). Such an arrangement comprises two radial supports spaced apart, axial supports and a magnetic chuck with a driving member having a plane face. The magnetic chuck is used to press the workpiece not only against the driving member, but also against the axial and radial supports. The workpiece is brought into rotation by the torque greater than the total moment of the forces inhibiting its rotation. This is achieved due to the fact that the magnetic flux ensuring the engagement between the workpiece and the driving member is greater than the magnetic flux pressing said workpiece against the supports.

Along with certain advantages this arrangement has a serious disadvantage, namely it is difficult to position and rorate miniature workpieces with a required accuracy, since the workpiece surface contacting with the magnetic chuck should as well as the cross-sectional area of the workpiece be large enough to let therethrough the magnetic flux of required value.

However, this method for positioning and rotating a circular workpiece as well as the arrangement implementing this method fails to meet the requirements of the workpiece high-precision rotation, which reduces the accuracy of workpiece machining, e.g. grinding races of miniature ball bearings.

Also known are a method for positioning and rotating a circular workpiece with a plane positioning face, and an arrangement implementing the same (cf. USSR Inventor's Certificate No. 280,262). According to this method, the workpiece is positioned on fixed radial and axial supports and the torque is transmitted thereto due to the forces of friction developed between said workpiece and a rotary driving member. This method makes use of a common knowledge residing in that the excitement of the ultrasonic mechanical vibrations in the zone of contact between two moving members which leads to severe decrease of the forces of friction between said members. On the strength of this fact and in order to improve the workpiece position on the supports, this method provides for feeding mechanical vibrations both to axial and radial supports, said vibrations being fed to the supports in the same direction. The workpiece is caused to be rotated by the driving member torque exceeding the total moment of the forces of friction developed between the workpiece and supports.

Implementing this method is the arrangement used for machining a workpiece and comprising a unit incorporating fixed radial supports being integral with fixed axial supports, said unit being rigidly connected with a waveguide of an electromechanical converter. The workpiece is placed on the supports and brought into contact with a cutting tool (grinding wheel). A frictional tang is applied to the workpiece plane face having no contact with the axial supports, said tang being connected with the driving member by means of a flexible diaphragm. A spring is used to press the tang against the rotating workpiece which is pressed, in turn, against the axial support. The workpiece is pressed against the radial supports by the displacement of the axes of the radial supports relative to the axis of the driving member. When the workpiece is in rotation, the whole unit including the supports vibrates with the ultrasonic frequency generated by the electromechanical converter.

In this case, the mechanical vibrations fed to the axial and radial supports are transmitted via the workpiece to the driving member. This causes the force of friction between the driving member and the workpiece to be reduced, which, in turn, reduces the torque transmitted from the frictional driving member to the workpiece.

Thus, the described methods of and apparatus for positioning and rotating a circular workpiece having a plane face fail to position and rotate a workpiece at high accuracy and stability, which is of considerable value for the high-procision machining of such workpieces, namely for grinding race rings of the miniature precision bearings or controlling over the quality of machining.

It is an object of the present invention to provide a method for positioning and rotating a workpiece shaped like a body of rotation and having a plane positioning face, and a simple and reliable arrangement implementing the same and ensuring the workpiece position and rotation at very high degrees of accuracy, thus increasing the accuracy of the workpiece machining, e.g. grinding, and ensuring the higher accuracy of the control over the workpiece dimensions and shape.

Another object of the present invention is to provide the positioning and rotation of a circular workpiece made both from magnetic and nonmagnetic material.

Still another object of the present invention is to provide the positioning and rotation of a circular workpiece, permitting to machine, e.g. to grind, all the surfaces of the workpiece, such as outer and inner races of bearings.

Yet another object of the present invention is to increase the standard dimensional range of circular workpieces to be machined with this arrangement.

A further object of the present invention is in that the arrangement implementing this method be simple in design and inexpensive in manufacture.

Still further object of the present invention is to increase the operational life of the arrangement implementing this method.

Yet further object of the present invention is to provide the simple setting-up and maintenance of the arrangement implementing this method.

With these and other objects in view, there is proposed a method for positioning and rotating a workpiece shaped like a body of rotation and having a plane face, residing in that the workpiece is positioned on axial and radial supports, the torque is transmitted to the workpiece due to the frictional forces of workpiece interaction with a rotary driving member, and mechanical ultrasonic vibrations are fed to at least one of the supports, wherein, according to the invention, the mechanical ultrasonic vibrations are fed to one of the supports in the direction substantially parallel to or at an angle not exceeding 10 degrees with the common line of contact between the workpiece and said support.

As compared to the prior art methods, the advantage of the proposed method for positioning and rotating a circular workpiece having a plane face resides in that the mechanical vibrations fed to the axial or radial supports in accordance with the present invention are propagated most efficiently, as a result the force of friction is caused to be reduced only between the workpiece and the support exposed to said vibrations and is caused to be constant between the workpiece and the driving member.

In accordance with one embodiment of the present invention, the mechanical ultrasonic vibrations have the asymmetrical shape during at least a part of the operating cycle.

In this case, the mechanical ultrasonic vibrations may have a saw-tooth shape.

The shape of the ultrasonic mechanical vibrations, e.g. saw-tooth shape is useable to perform auxiliary operations during the process of positioning and rotating a workpiece, namely to displace a workpiece with respect to the radial and axial supports.

With these and other objects in view, there is also proposed an arrangement for positioning and rotating a workpiece, comprising an axial and a radial supports adapted to position the workpiece, a rotary driving member engaging the workpiece, and at least one electromechanical converter operating within the ultrasonic range and having a waveguide adapted for feeding mechanical vibrations to at least one of said supports, wherein, in accordance with the present invention, the axial and radial supports are accomplished separate, and the waveguide is arranged parallel to or at an angle not exceeding 10 degrees with the line of contact between the workpiece and the support.

The proposed arrangement permits the mechanical ultrasonic vibrations to be fed separately to each of the supports in the optimum direction, as a result of which the friction developed between the workpiece and the supports is caused to be reduced, while the friction developed between the workpiece and the driving member is constant. As a consequence, the torque and the pressure of the driving member are found to be reduced with the result that the accuracy of rotation is little dependent upon the accuracy of manufacture and operation of the drive members which are warn with time, thus permitting the arrangement to be simple in design, inexpensive in manufacture and easy in operation.

It is advisable that the converter should be operatively associated with the support disposed opposite to the zone of the workpiece contact with the driving member.

In this case, upon feeding the mechanical ultrasonic vibrations, the friction is decreased between the workpiece and that support where the friction has its maximum value because of the driving member pressure transmitted via the rotating workpiece to said support.

In accordance with one embodiment, the converter is accociated with the radial support.

In accordance with another embodiment of the present invention, the converter is associated with the axial support.

Still another embodiment of the present invention consists in that the arrangement incorporates two converters, the first converter being associated with the radial support, while the second converter is associated with the axial support.

The use of two converters, each being associated with one of the supports, makes it possible to find the optimum conditions of the mechanical ultrasonic vibrations fed to the radial and axial supports which are caused to be operated in different manner.

Yet another embodiment of the invention consists in that the driving member is shaped like a roller having a resilient ring mounted thereon and being in contact with the peripheral surface of the workpiece.

Such a design of the driving member, which can be acieved owing to the possibility of application a decreased torque, permits wobbles between the workpiece and the driving member to be reduced, thus ensuring an increased accuracy of workpiece rotation.

In accordance with another embodiment of the present invention, the roller resilient ring is provided with rims, the distance therebetween ensuring a negative clearance with respect to the workpiece width.

Such a design of the driving member is directed towards refining transmission of the torque from the driving member to the workpiece without increase in the driving member pressure upon the workpiece.

Still another embodiment of the present invention resides in that the driving member is shaped like a roller having a resilient ring contacting with the workpiece outer face.

The driving member is designed to press the workpiece against the radial and axial supports simultaneously.

Yet another embodiment of the present invention is that the driving member is shaped like a roller with a ring having two collars being in contact with the workpiece peripheral surface and with its face, respectively.

According to this embodiment, the driving member permits the torque transmitted therefrom to the rotating workpiece to be increased.

Other and further objects and advantages of the invention will be better understood from the following description taken in conjunction with the accompanying drawings illustrating the preferred embodiments of the invention, wherein:

FIG. 12 is a view of a waveguide having a hollow diametrically disposed slot with a charger arranged therein;

FIG. 13 is a cross-sectional view taken along line XIII—XIII of FIG. 12;

FIG. 14 is a view of yet another embodiment of the arrangement having an axial support secured to the additional waveguide, in accordance with the present invention;

Figure 1:
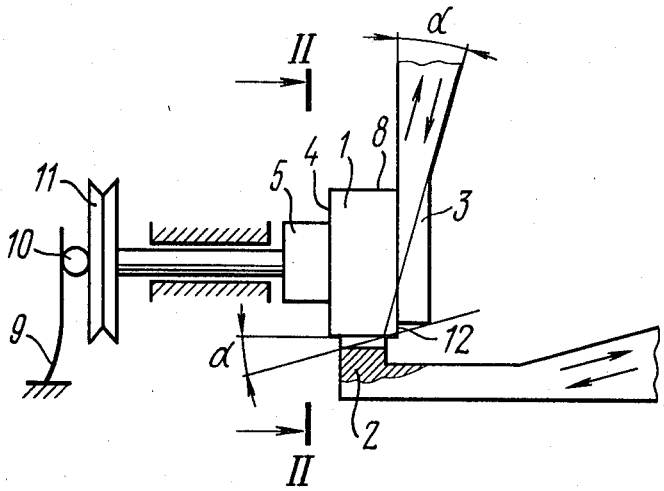
FIG. 1 is a skeleton diagram illustrating a method for positioning and rotating a workpiece guided over its plane face.

The method for positioning and rotating a circular workpiece guided over its plane face should be understood from the simplified skeleton diagram shown in FIG. 1.

Figure 2:
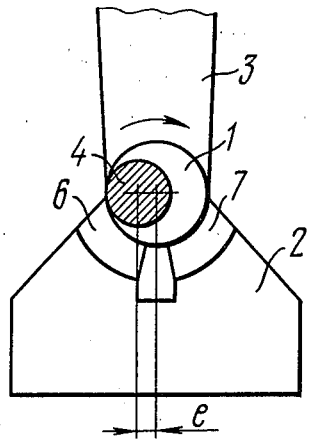
FIG. 2 is a cross-sectional view taken along line II—II of FIG. 1.

A workpiece 1 is positioned on a radial support 2 and an axial support 3, and is brought into rotation by the forces of friction developed between a workpiece plane face 4 and a rotary driving member 5. In order to ensure the reliable positioning of the workpiece 1 on the radial support 2, the latter consists of two parts 6 and 7 (FIG. 2), said parts being spaced apart through a certain angle and having the profile in the working part congruent to the profile of a workpiece cylindrical surface 8 (FIG. 1). The driving member 5 is pressed against the workpiece plane face 4 by an elastic force element 9 via a ball 10 and is caused to be rotated by a belt transmission (not shown) with a pulley 11. The workpiece 1 is pressed with its plane face 12 against the axial support 3 by the force element 9 via the driving member 5 and, against the radial support 2 due to its eccentric position with respect to the axis of rotation of the driving member 5 (FIG. 2).

An electromechanical converter (not shown) feeds ultrasonic mechanical vibrations to the axial and radial supports (3 and 2) (FIG. 1) in two directions, one of which being substantially parallel to the common line of contact between the workpiece 1 and the radial support 2, while the other direction is substantially parallel to the common line of contact between the workpiece 1 and the axial support 3. The variation of each of the directions from the respective line of contact may comprise an acute angle $\alpha$.

It is enough to feed the ultrasonic mechanical vibrations only to one of the supports, but preferably to the support disposed opposite to the driving member 5. In this case, it is preferably to feed the vibrations to the axial support 3, but, however, it is also possible to feed the mechanical vibrations to both supports 2 and 3 simultaneously as shown in FIG. 1.

The mechanical vibration conditions (namely frequency, amplitude, shape) as well as a limiting value of the angle $\alpha$ are prescribed according to the following conditions described hereinbelow.

In the general case, the ultrasonic mechanical vibrations, when fed to the radial and axial supports 2 and 3, are at the same time transmitted to some extend to the workpiece 1 and via the latter to the driving member 5. It should be noted that the coefficient of friction developed between the workpiece 1 and the driving member 5, as well as the coefficient of friction developed between the workpiece 1 and the radial and axial supports 2 and 3, is substantially dependent upon the magnitude of the displacements accompanying said vibrations and occuring between the driving member 5 and the workpiece 1 and between the latter and the radial or axial support 2 or 3. The change in direction of the vibration feeding, relative to the line of contact between the workpiece 1 and one of the support 2 or 3, alters the magnitudes of said displacements, thus altering the forces of friction between the workpiece 1 and the driving member 5, and between the workpiece 1 and one of the supports 2,3.

The force of friction developed between the driving member 5 and the workpiece 1 determines the torque transmitted to the workpiece 1 and being essential to rotate the latter, while the force of friction developed between the workpiece 1 and one of the supports 2 and 3 hinderes the workpiece rotation and is to be minimized. A limiting value of angle $\alpha$ is selected to ensure the optimum relationship between the components of the mechanical vibrations fed to the supports, thus minimizing the drag friction developed between the workpiece 1 and one of the supports 2 and 3, with simultaneous conservation of the useful friction between the workpiece 1 and the driving member 5, and retaining the workpiece 1 to be stationary, while the supports 2 and 3 being under vibrations. Morever, this effect is also achieved by the fact that the mechanical vibrations fed to the supports are differentiated with respect one to another.

The frequency and amplitude of such vibrations are selected with regard to the workpiece dimensions and shaped.

According to the proposed method, the frequency of vibrations fed to the radial support 2 and to the axial support 3 is in the range from 15 to 35 kc/s the vibration amplitude is in the order of 1 to 3$\mu$, while the angle $\alpha$ is prescribed no more than 10 degrees (for purposes of clarity, the angle $\alpha$ has a rather large value as represented in the accompanying drawings).

Figure 3:
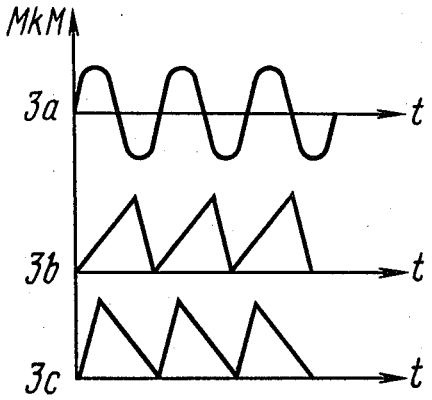
FIG. 3 is timing charts of mechanical vibrations produced by an electromechanical converter and fed to the supports.

According to the proposed method, the mechanical vibrations may take any symmetrical shope, e.g. the sinusoidal shape (FIG. 3*a*), during a major part of its operating cycle. The saw-tooth mechanical vibrations (FIG. 3*b, c*) are used to shift the workpiece 1 (FIG. 1) along the radial support 2 relative to the axial support 3. In this case, the vibrations shaped like shown on the timing chart (FIG. 3*b*) and having the trailing edge time of a saw-tooth pulse less than its leading edge time are applied to shift the workpiece 1 relative to said supports and to press it additionally against the axial support 3 (FIG. 1). Similarly, the vibrations shaped as shown on the timing chart (FIG. 3*c*) and having the trailing edge time of a saw-tooth pulse greater than its leading edge time are applied to withdrawn the workpiece 1 (FIG. 1) from the zone of its machining after completing the grinding process.

The relationship between the trailing edge and leading edge times of saw-tooth pulses fed to the supports 2 and 3 is a function of the workpiece overall dimensions, its material, degree of roughness of the pretreated workpiece surfaces contacting with the radial and axial supports 2 and 3, to which the mechanical vibrations are fed.

Figure 4:
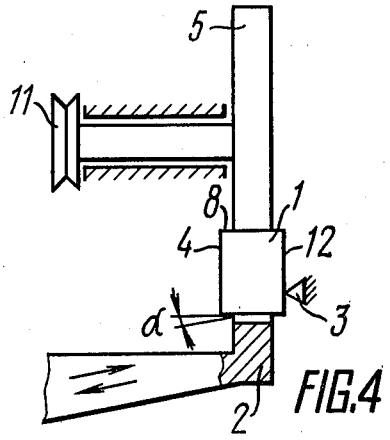
FIG. 4 is a skeleton diagram illustrating another embodiment of this method, according to which a workpiece is guided over its peripheral surface.

FIG. 4 shows an embodiment wherein the workpiece 1 positioned on the radial support 2 and the axial support 3 is caused to rotate by the forces of friction developed between the end face of the driving member 5 and the workpiece peripheral surface 8, the driving member 5 being brought into rotation by the belt transmission and the pulley 11.

According to this embodiment, the mechanical vibrations are fed only to the radial support 2 arranged opposite to the driving member 5. The workpiece 1 is pressed against the radial support 2 by the driving member 5 and, against the axial support 3 by the axial force caused by the saw-tooth vibrations, such a shape providing for its leading edge time being greater than its trailing edge time. The workpiece 1 is additionally pressed against the axial support 3 by the axial component of the forces of workpiece interaction with the axial support 3, said axial component arising from the mechanical vibrations fed at an acute angle to the line of contact between the workpiece 1 and the radial support 2, and directed to the axial support 3.

Therefore, the workpiece 1 is brought into rotation by the driving member torque exceeding the total moment of all drags hindering the workpiece rotation, such an exceeding being attained due to the fact that the friction developed between the workpiece 1 and the supports 2 and 3 is substantially reduced. A substantial decrease in the forces of friction hindering the workpiece rotation permits the torque of a rather small magnitude to be transmitted and, therefore, the driving member 5 is slightly pressed against the workpiece 1, thus permitting to apply a means for damping the driving member wobbles which unfailingly accompany the driving member rotation.

The arrangement implementing this method adapted for positioning and rotating a circular workpiece and used mainly for grinding of inner bearing races, can be employed in a grinding machine comprising a bed 13 (FIG. 5) with a unit 14 mounted thereon and used for positioning and rotating the workpiece 1, a carriage 15 of a charger 16, and a spindle 17 having a clamping chuck 18 and an abrasive tool 19 which in the present case is a grinding wheel suitable to gring the inner bearing races.

The unit 14 comprises a fixed electromechanical magnetostrictive converter 20 operating within the ultrasonic range and enclosed within a hollow housing 21 provided with pipes 22 to direct the cooling liquid therein. The converter 20 comprises a laminated core 23 with a winding 24 wound thereon and connected to an ultrasonic-frequency oscillator (not shown), and a waveguide 25 having a shape such as to concentrate the energy of vibrations produced by the electromechanical converter 20, the waveguide 25 being rigidly connected to the converter laminated core 23.

The radial support 2 used for the radial positioning of the workpiece 1 is arranged on the free end portion of the waveguide 25 provided with an axial passageway 26 formed therein and adapted for passing a rod 27 of a plug gauge 28, and with a side window 29 to receive the axial support 3 extending therethrough, the axial support being used for positioning the workpiece 1 in the axial direction. The waveguide 25 is placed in parallel with the line of contact between the workpiece 1 and the radial support 2. The axial support 3 is mounted within a holder 30 located within a slot 31 of a unit 32 adapted for locking the axial support 3, the holder position being regulated within the limits defined by restricting pins 33 and locked by a thrust screw 34 pressing the holder to the right wall of the slot 31.

Figure 5:
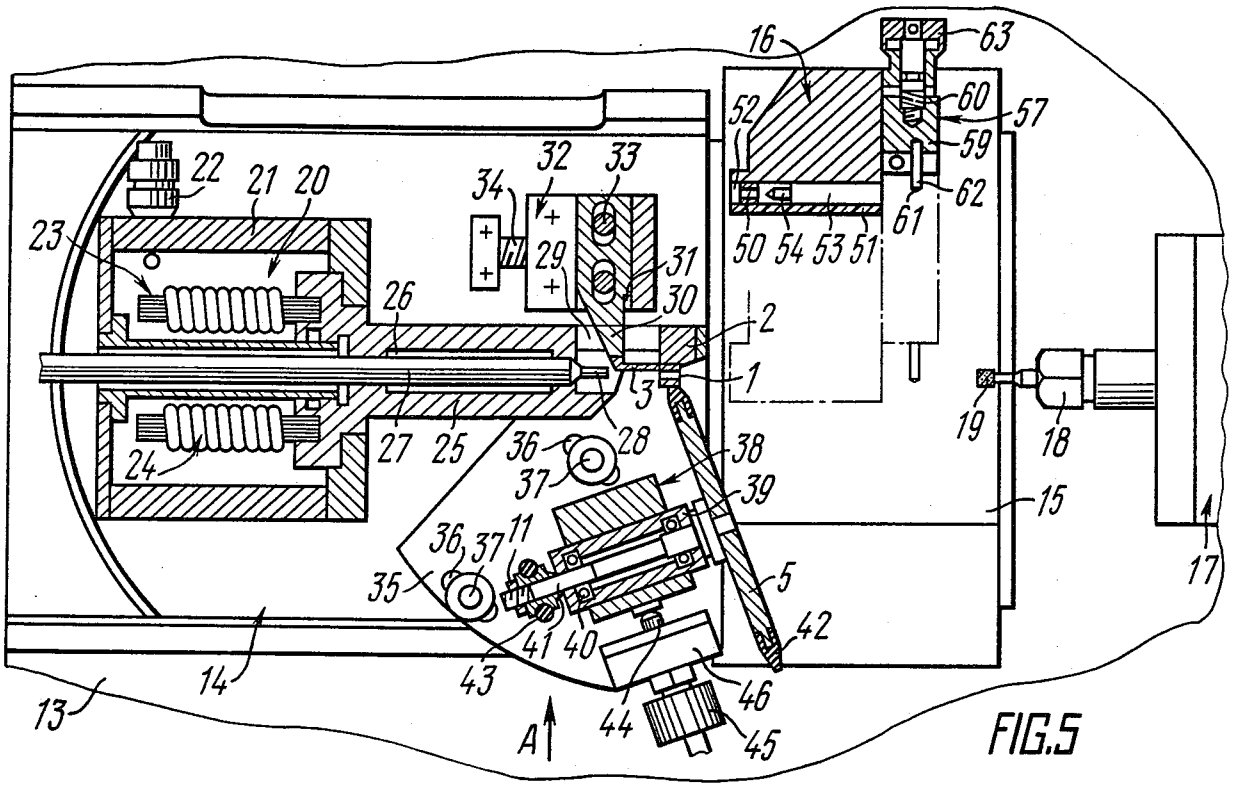
FIG. 5 is a plan view of an arrangement for positioning and rotating a workpiece, in accordance with the present invention.

The unit 14 adapted for positioning and rotating the workpiece 1 comprises a movable bed 35 with slits 36 cut therein and permitting the bed 35 to be turned through a certain angle relative to the zone of the workpiece interaction with the axial and radial supports 3 and 2, the bed 35 being locked by locking screws 37. Secured to the bed 35 is a drive 38 adapted to press the driving member 5 against the workpiece 1 and comprising a spindle 39 with a shaft 41 mounted in bearings 40. One end of the shaft 41 is provided with the frictional rotary driving member 5 secured thereto and shaped like a roller with a ring 42 made from a resilient material, e.g. rubber, while the other end of the shaft 41 accommodates the pulley 11 secured thereto and linked with a belt 43 to an electric motor (not shown). The axis of the shaft 41 is directed at an acute angle not exceeding 45 degrees with the axis of the workpiece 1. The ring 42 of the driving member 5 is positioned for frictional continuous engagement with the workpiece facet which is opposite to the zone of the workpiece contact with the radial and axial supports 2 and 3. The position of the driving member 5 is defined by an abutment 44 mounted on a bracket 46 and having a locking nut 45. The carriage 15 rests upon rolling guides 47 shown in FIG. 6 (view in direction of arrow A of FIG. 5) and comprising rollers 48. The guides 47 are arranged perpendicular to the workpiece axis and connected with a drive (not shown) determining the cycle of operation. Mounted on the carriage 15 is the charger 16 having a vertical feed tray 49 adapted for placing stacked circular workpieces 50 thereon. The exit of the feed tray 49 is closed with a transparent cover 51 (FIG. 5). The charger 16 has a slot 52 disposed perpendicular to the feed tray 49 and in parallel with the plane of the carriage 15, and having a push-rod 53 slipping therein and provided with a mandrel 54 interacting with the opening of the circular workpiece 50. A drive adapted to move the push-rod 53 comprises a rack 55 (FIG 6) engaging a gear wheel 56 operatively associated with a motor (not shown). The charger 16 is provided with a unit 57 adapted for truing and dressing of the grinding wheel 19, and comprising a guide 58 with a carriage 59 arranged thereon. The carriage 59 is operatively associated with a fine-adjustment screw 60 (FIG. 5) and provided with a diamond 61 mounted in a holder 62 and adapted for truing and dressing the peripheral surface of the grinding wheel 19. Secured to the fine-adjustment screw 60 is a graduated circle 63 adapted for reading the deflection magnitude of the diamond 61. The operative position of the charger 16 is shown by a dash-and-dot line.

Figure 6:
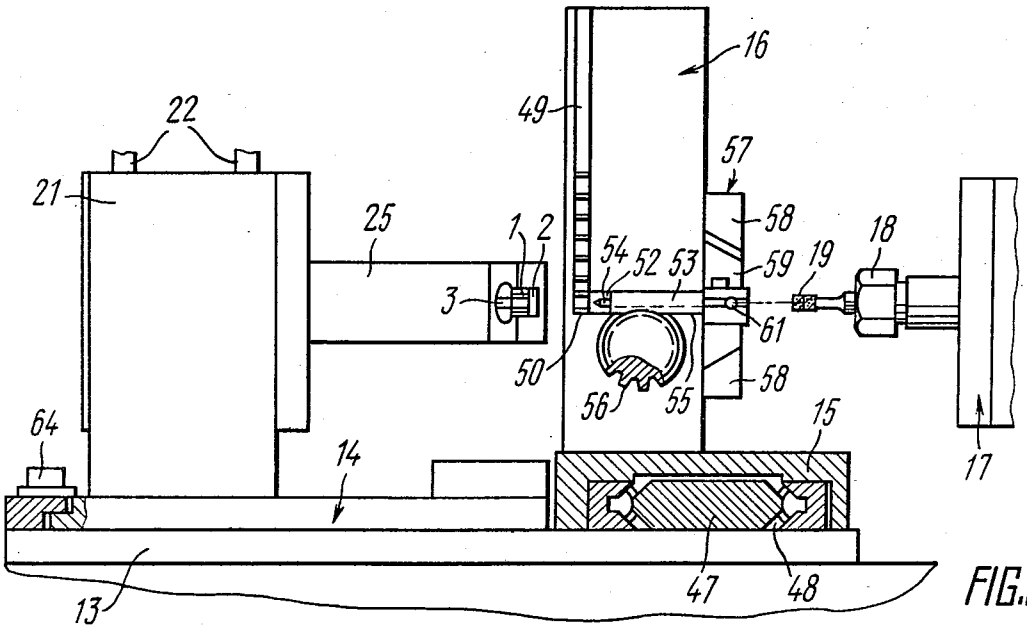
FIG. 6 is the same arrangement of FIG. 5, viewed in direction indicated by arrow A.

The unit 14 adapted for positioning and rotating a workpiece is bolted to the bed 13 in 64 (FIG. 6).

Figure 7:
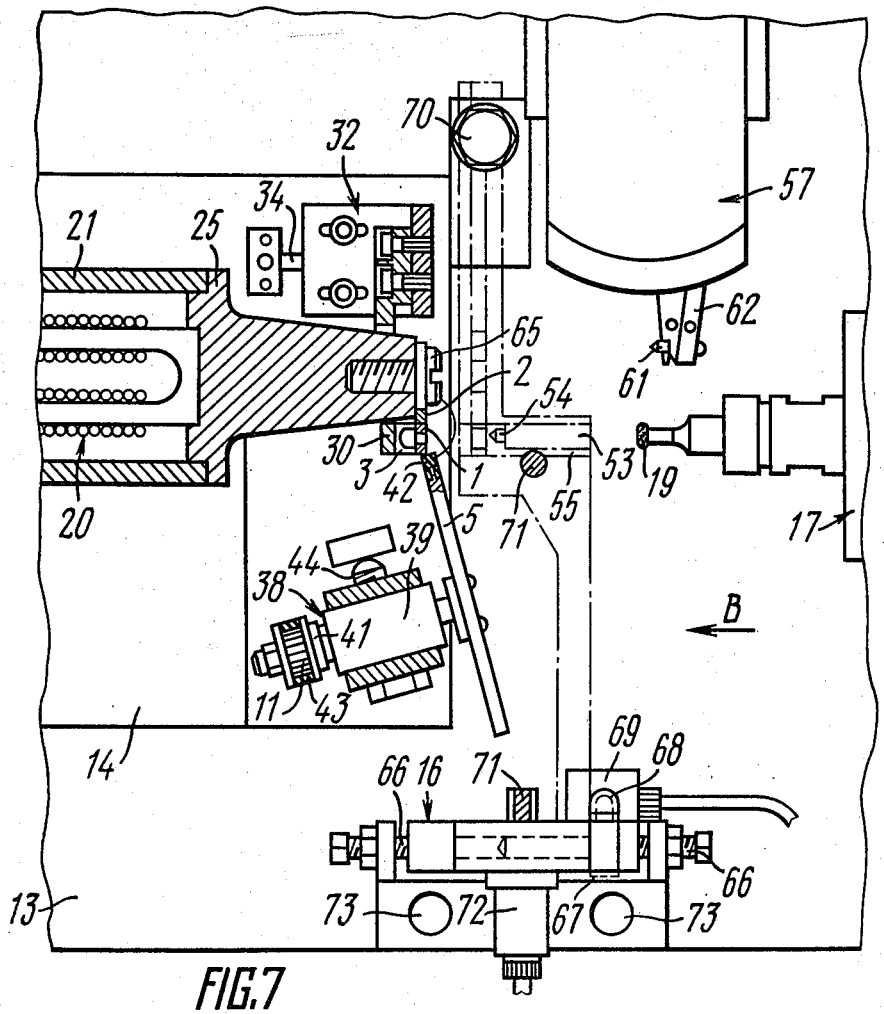
FIG. 7 is a plan view of another embodiment of an arrangement for positioning and rotating a workpiece, in accordance with the present invention.
Figure 8:
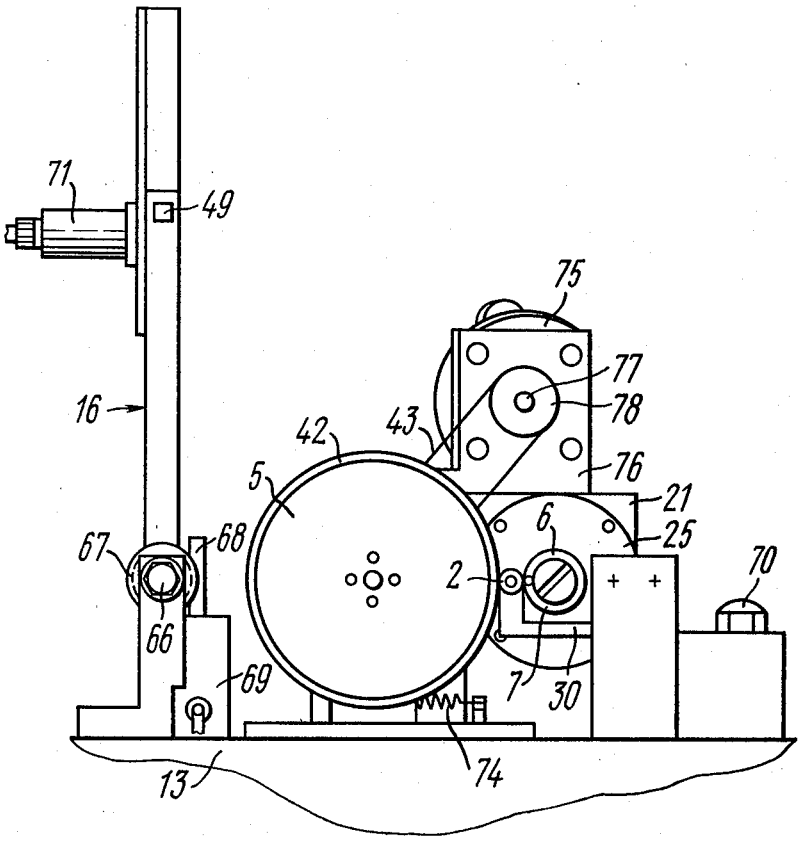
FIG. 8 is the same embodiment of FIG. 7, viewed in direction of arrow B.

The embodiment shown in FIGS. 7 and 8 (view in direction of arrow B of FIG. 7) has essentially the same arranging, as the embodiment shown in FIGS. 5 and 6.

In this case, the waveguide 25 (FIG. 7) is solid and provided with the radial support 2 secured to its free end with a screw 65 and shaped like a washer with a profile cut-out, thus making up two portions 6 and 7 of the radial support 2 (FIG. 8). The axial support 3 mounted in the holder 30 (FIG. 7) is shaped like a cup contacting with the workpiece plane face.

The operating surface of the grinding wheel 19 is of toroidal form congruent to the profile of the raceway of the workpiece 1. The holder 62 of the diamond 61 used for, truing and dressing the grinding wheel 19 in the radial direction is mounted pivotally.

The charger 16 is accomplished reversible to lead it off the operative zone. The charger 16 is mounted in centers 66 and provided with a toothed ring 67 engaging with a rack 68 of a cylinder 69 adapted for leading the charger 16 off the operative zone. The position of the charger 16, during the charging process, is fixed with a stop 70 and shown by a dash-and-dot line (FIG. 7). The rack 55 mounted on the push-rod 53 has skew teeth engaging with skew teeth of a rack 71 of a cylinder 72. The charger 16 is secured to the bed 13 with screws 73.

The driving member 5 (FIG. 8) is spring-biazed by a helical spring 74. A drive rotating the workpiece 1 comprises an electric motor 75 with a reducer arranged therein, mounted on a bracket 76 and having a pulley 78 fitted to a reducer shaft 77 and embraced by the belt 43.

Figure 9:
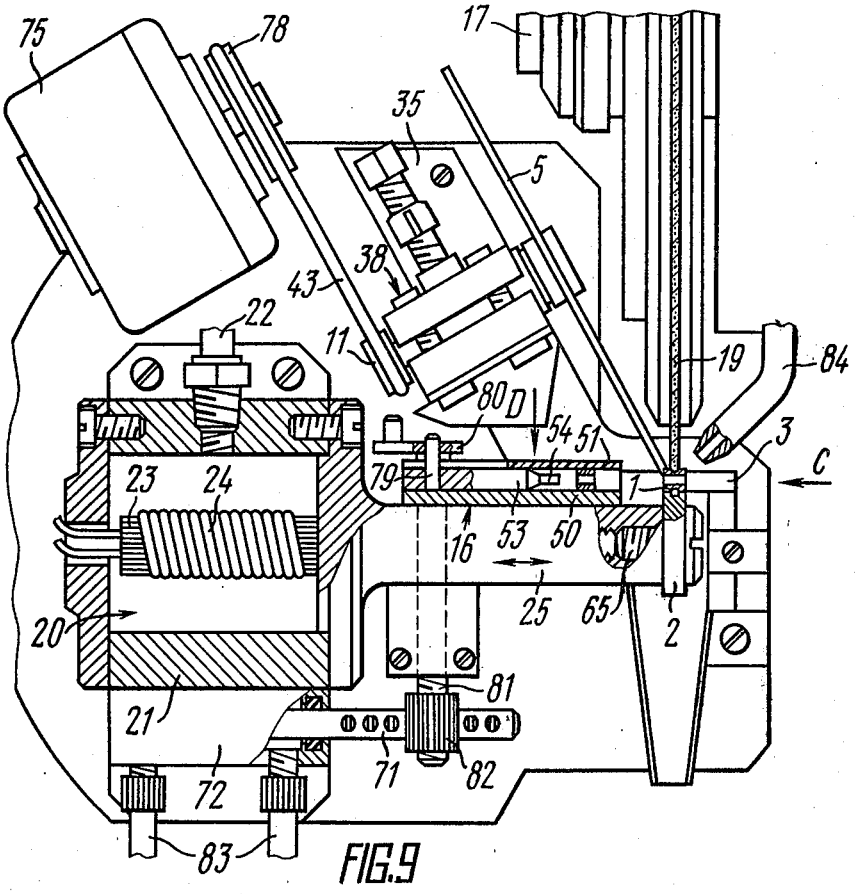
FIG. 9 is a plan view of still another embodiment of this arrangement, in accordance with the present invention.

FIG. 9 shows the embodiment adapted for grinding an outer raceway of the inner race ring of a ball bearing assembly. The embodiment shown in FIG. 9 has essentially the same arranging, as the embodiments mentioned above.

Figure 10:
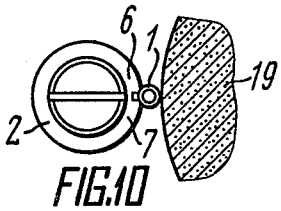
FIG. 10 is the embodiment of FIG. 9, viewed in direction of arrow C.

According to this embodiment, the waveguide 25 is accomplished solid and with the radial support 2 secured to its free end with the screw 65 and shaped like a washer with a profile cut-out dividing said support 2 into two parts 6 and 7 of said support 2, as shown in FIG. 10 which illustrates a view in direction of arrow C of FIG. 9, the axial support 3 being not shown. Moreover with this embodiment, the spindle 17 is provided with the grinding wheel 19 of large diameter, applied to the outer peripheral surface of the workpiece 1.

The charger 16 (FIG. 9) is located adjacent to the waveguide 25. The drive of the push-rod 53 includes a stud 79 mounted on the pushrod 53 and interacting with a jaw 80 connected to a shaft 81 having a pinion 82 secured thereto and engaging with the rack 71 of the cylinder 72 having nozzles 83 to feed working fluid therethrough.

Figure 11:
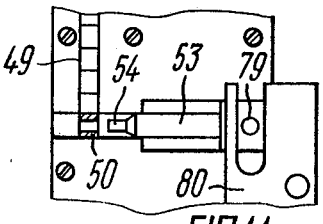
FIG. 11 is the embodiment of FIG. 9, viewed in direction of arrow D.

Another embodiment of the charger 16 is shown in FIG. 11 representing a view in direction of arrow D of FIG. 9, the Cover 51 being removed. A nozzle-type ejector 84 (FIG. 9) is adapted to withdrawn the workpiece 1 from the radial support 2, air or coolant being directed through said ejector to the working zone.

FIGS. 12 to 17 show the embodiments of various units and members of the proposed arrangement.

As can be seen in FIG. 12, the waveguide 25 has a diametrically disposed through slot 85 suitable to accommodate the charger 16 having the feed tray 49, with the workpieces 50 being placed thereon. In this case, the axis of the push-rod 53 and the mandrel 54 makes an angle $\beta$ of 2 to 5 degrees with the axis of the workpiece 1.

The waveguide 25, according to FIG. 13, has also the through slot 85 suitable to accommodate the charger 16.

Referring now to FIG. 14, the axial support 3 is secured to a waveguide 86 of an additional electromechanical converter (87), placed substantially in parallel with the workpiece end face 12. The driving member 5 is shaped like a roller with the resilient ring 42 mounted thereon and contacting with the outer facet of the workpiece 1.

Figure 15:
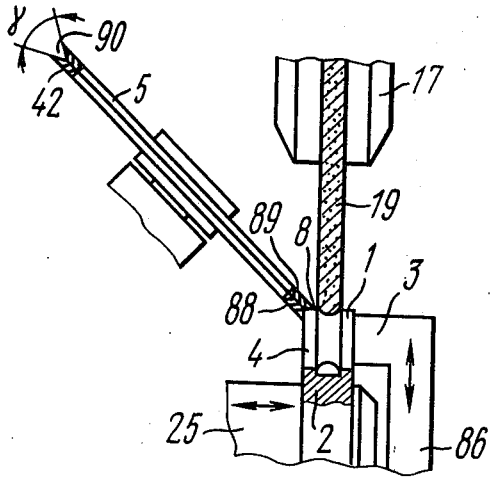
FIG. 15 is a view of a driving member shaped like a roller with a resilient ring having two collars.

According to FIG. 15, the driving member 5 is shaped like a roller with the resilient ring 42 mounted thereon and having two collars 88 and 89 being in contact with the workpiece end face 4 and its peripheral surface 8, respectively, and forming an angular groove 90 over the peripheral surface of the driving member 5. An angle $\gamma$ formed by the side surfaces of the angular groove 90 can be less than 90 degrees, thus permitting the workpiece 1 to be locked between said side surfaces, which increases the torque transmitted from the driving member 5 to the workpiece 1.

Figure 16:
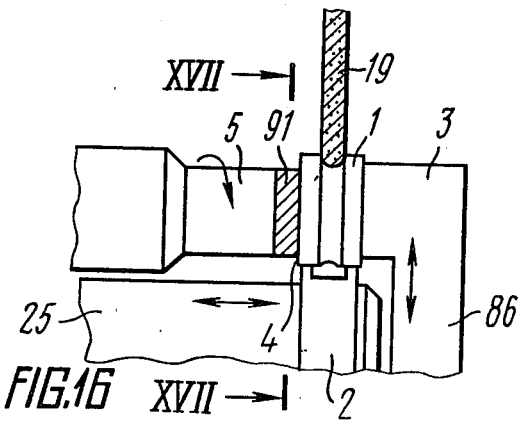
FIG. 16 is a view of still another embodiment of the arrangement, wherein the driving member has the face friction plate.
Figure 17:
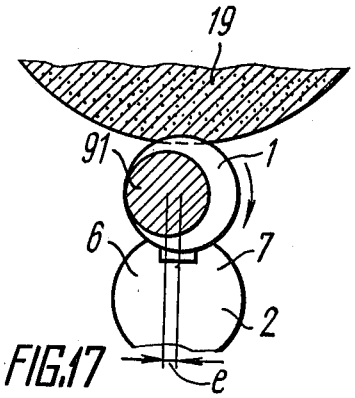
FIG. 17 is a cross-sectional view taken along line XVII—XVII of FIG. 16.

According to FIG. 16, the driving member 5 has a frictional pad 91 disposed on its end face and contacting with the workpiece plane face 4, the axis of rotation of the driving member 5 (FIG. 16) being in parallel with the axis of rotation of the workpiece 1 and displaced therefrom by "e" (FIG. 17).

Figure 18:
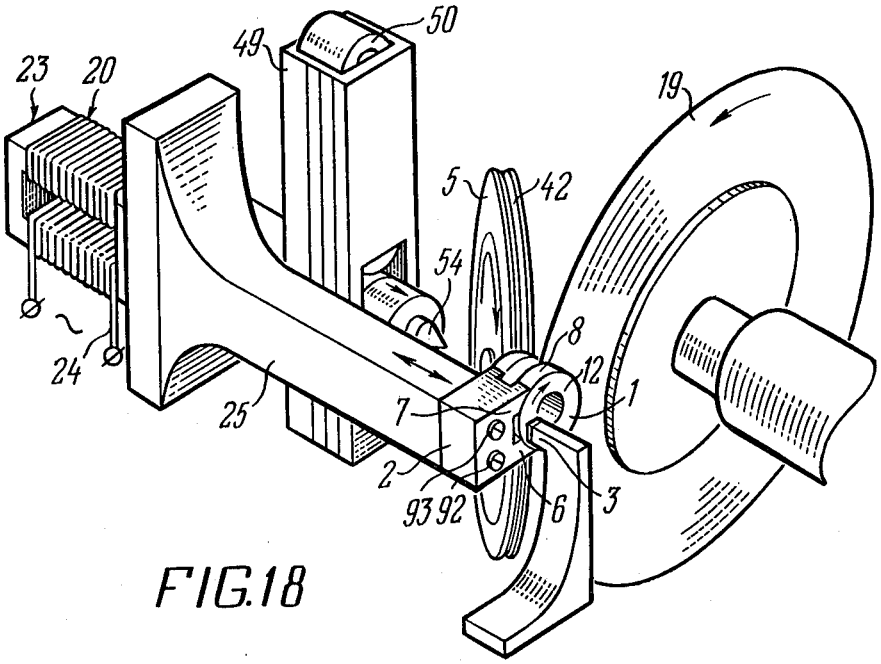
FIG. 18 is a perspective view of another embodiment of the arrangement, in accordance with the present invention.

FIG. 18 shows a perspective view of the embodiment of the proposed arrangement adapted to be used in a grinding machine for grinding raceways of ball bearing races. In this case, the waveguide 25 is rectangular in cross section as is the radial support 2 bolted to the free end of the waveguide 25 in 92 and 93. The axial support 3 is fixed and contacts with only a part of the plane face 4 of the workpiece 1 being machined by the grinding wheel 19 of large diameter.

Figure 19:
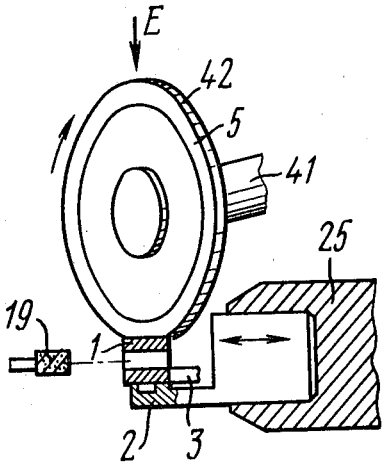
FIG. 19 is a view of a driving member shaped like a roller having the contact with the peripheral surface of a workpiece.
Figure 20:
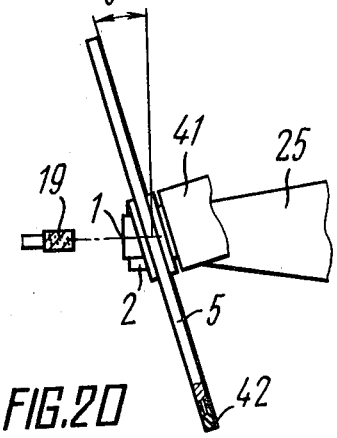
FIG. 20 is the same driving member of FIG. 19, viewed in direction of arrow E.

FIG. 19 shows the embodiment of the proposed arrangement adapted to be used in a grinding machine for grinding the openings of ball bearing inner races. The driving member 5 is shaped like a roller contacting with the workpiece peripheral surface 8. The axial supports 3 is rigidly fixed. The radial support 2 is secured to the waveguide 25 placed in parallel with the line of contact between the workpiece 1 and the radial support 2, the axis of symmetry of the waveguide 25 being coincident with the axis of rotation of the workpiece 1. The driving member 5 (FIG. 21) is spaced at an angle $\delta$ of 2 to 4 degrees to the axis of rotation of the workpiece 1, thus pressing the latter to the axial support 3.

Figure 21:
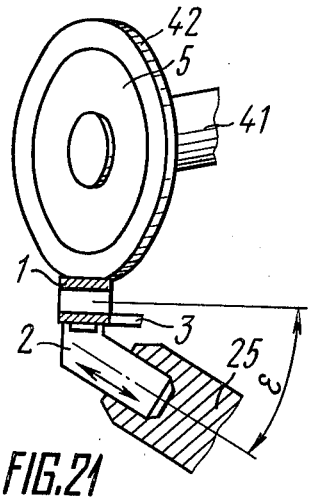
FIG. 21 is another embodiment of the arrangement, wherein the waveguide of the electromechanical converter is arranged at a certain angle to the line of contact between a workpiece and a driving member.

According to FIG. 21, the waveguide 25 with the radial support 2 secured thereto is placed at an angle $\epsilon$ of 5 to 10 degrees to the line of contact between the workpiece 1 and the radial support 2, thus also permitting the workpiece 1 to be pressed against the axial support 3.

Figure 22:
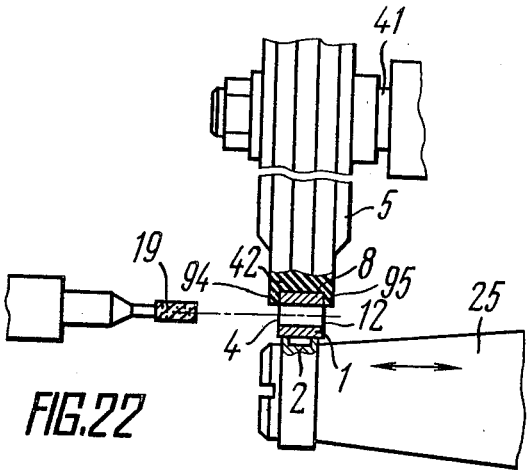
FIG. 22 is a view of a driving member shaped like a roller having a resilient ring with rims.

According to FIG. 22, the driving member 5 is shaped like a roller with a resilient ring 42 having rims 94 and 95, the distance therebetween ensuring a negative clearance with respect to the workpiece width. The driving member 5 has its axis of rotation parallel with that of the workpiece 1 and contacts with the workpiece peripheral surface 8 and with its plane faces 4 and 12, thus increasing the torque transmitted from the driving member 5 to the workpiece 1.

The proposed method for positioning and rotating a workpiece shaped like a body of rotation, as well as the arrangement implementing the same, permits the workpiece to be positioned on the supports and rotated with significantly increased accuracy and reliability, since the skeleton diagram achieved with the proposed method is free from the precision and unreliable frictional rotary driving members made of hard alloys, the accuracy of the workpiece machining being greatly dependent on both accuracy of manufacture and operational features of said members.

The proposed method turns out to be sufficiently versatile since when adapted for grinding race rings of ball bearings, it permits:

positioning a workpiece over its end face, or over its inner or outer cylindrical surfaces;

positioning and rotating a workpiece made from both magnetic and nonmagnetic materials;

machining both inner and outer race rings of ball bearings, and their raceways;

machining race rings of minicature ball bearing assemblies.

It should be noted that the proposed arrangement implementing this method for positioning and rotating a workpiece permits;

the zone of workpiece machining to be well visible and easily accessible for inspection, setting-up and maintenance;

the accuracy of the workpiece machining to be little dependent upon the accuracy of both manufacture and operation of the driving members due to the improved skeleton diagram used with the proposed method and described hereinabove, and also due to damping of the vibrations with a resilient material, such as rubber, surrounding the frictional disk thus ensuring the smooth rotation of the workpiece and damping vibrations transmitted from the bearings of the driving member shaft to the workpiece;

the driving member speed to be sufficiently reduced, as compared with that of the workpiece, by increasing the diameter of the driving member, the operational accuracy of the skeleton diagram members being not critical;

the workpiece geometry to be substantially improved, with respect to its base surface, since it is suitable to machine the workpiece between the supports.

The proposed arrangement permits to use any kind of coolant, such as harmless coolant based on water, and even to grind without it.

Moreover, the propose arrangement is free of high-speed members and members adversely affecting, because of its wear, on the workpiece geometry, thus simplifying the arrangement setting-up and incresing the reliability and life thereof.

While the invention has been described herein in terms of preferred embodiments, numerous variations may be made in the arrangement illustrated in the drawings and herein described without departing from the invention as set forth in the appended claims.

What is claimed is:

1. A method for positioning and rotating a workpiece shaped like a body of rotation, the method being used during workpiece machining and controlling dimensions and shape of the workpiece, the method comprising the following steps:

positioning said workpiece on a support system comprising an axial support and a radial support, thus ensuring the respective lines of contact between said workpiece and said supports;

engaging a surface of said workpiece with a rotary driving member;

bringing said workpiece into rotation by torque transmitted from said rotary driving member to said workpiece due to the forces of friction developed therebetween;

feeding independent ultrasonic mechanical vibrations to each of said supports of said support system in a direction parallel to or at an angle not exceeding 10 degrees with the line of contact between said workpiece and respective ones of said supports;

whereby the frictional interaction between said driving member and said workpiece is maintained substantially without interference from said ultrasonic mechanical vibrations, while the forms of friction developed between said workpiece and said support system are significantly reduced due to said ultrasonic mechanical vibrations fed thereto.

2. A method for positioning and rotating a workpiece as defined in claim 1, wherein said ultrasonic mechanical vibrations fed to one of said supports take an asymmetrical form during at least a part of the operating cycle.

3. A method for positioning and rotating a workpiece as defined in claim 2, wherein said ultrasonic mechanical vibrations fed to one of said supports take a sawtooth form.

4. A method according to claim 1, wherein said ultrasonic mechanical vibrations are fed to said axial and said radial supports in directions that are substantially perpendicular to each other.

5. An arrangement for positioning and rotating a workpiece shaped like a body of rotation and having a plane face, the arrangement being used for workpiece machining and controlling dimensions and shape of the workpiece, said arrangement comprising:

a support system comprising a radial support for positioning said workpiece in a radial direction, and an axial support for positioning said workpiece in an axial direction;

frictional rotary driving means for engaging a portion of said workpiece;

two electromechanical converters operating within an ultrasonic range, each converter including a waveguide adapted to feed mechanical vibrations to one of said supports of said support system;

each of said waveguides being arranged to form an angle not exceeding 10 degrees with the line of contact between said workpiece and respective ones of said supports and being separated from said rotary driving means so that vibrations from said converters are isolated from said rotary driving means whereby the vibrations have substantially no effect on the frictional engagement between the rotary driving means and the workpiece.

6. An arrangement as defined in claim 5, wherein said driving member is shaped like a roller having a resilient ring and contacting with a peripheral surface of said workpiece.

7. An arrangement as defined in claim 6, wherein said resilient ring is provided with rims, the distance therebetween ensuring a negative clearance with respect to the workpiece width.

8. An arrangement as defined in claim 5, wherein said driving member is shaped like a roller having a resilient ring and contacting with an outer facet of the workpiece.

9. An arrangement as defined in claim 5, wherein said driving member is shaped like a roller with a resilient ring having two collars contacting with the workpiece peripheral surface and its face, respectively.

10. An arrangement according to claim 5, wherein said waveguides are arranged in such manner that ultrasonic mechanical vibrations are fed to said axial and said radial supports in directions that are substantially perpendicular to each other.

11. An arrangement for positioning and rotating a workpiece shaped like a body of rotation, the arrangement being used for workpiece machining and controlling dimensions and shape of the workpiece, the arrangement comprising:

a support system comprising a radial support for positioning said workpiece in a radial direction, and a stationary axial support for positioning said workpiece in an axial direction;

frictional rotary driving means for engaging said workpiece;

an ultrasonic electromechanical converter including a waveguide adapted for feeding mechanical vibrations directly to said radial support only;

said waveguide being placed at an angle not exceeding 10 degrees with the line of contact between said workpiece and said radial support, said waveguide being separated from said rotary driving means so that vibrations from said converter are isolated from said rotary driving means so that the vibrations have substantially no effect on the frictional engagement between the rotary driving means and said workpiece.

12. An arrangement as defined in claim 11, wherein said driving member is shaped like a roller with a resilient ring contacting with the workpiece peripheral surface.

13. An arrangement as defined in claim 12, wherein said resilient ring is provided with rims, the distance therebetween ensuring a negative clearance with respect to the workpiece width.

14. An arrangement as defined in claim 11, wherein said driving member is shaped like a roller with a resilient ring contacting with an outer facet of the workpiece.

15. An arrangement as defined in claim 11, wherein said driving member is shaped like a roller with a resilient ring having two collars contacting with both workpiece peripheral surface and its face, respectively.

16. A method for positioning and rotating a workpiece shaped like a body of rotation, the method being used during workpiece machining and controlling dimensions and shape of the workpiece, the method comprising the following steps:

positioning said workpiece on a support system comprising a stationary axial support and a radial support, thus ensuring the respective lines of contact between said workpiece and said supports;

engaging a surface of said workpiece with a rotary driving member;

bringing said workpiece into rotation by torque transmitted from said rotary driving member to said workpiece due to the forces of friction developed therebetween;

feeding ultrasonic mechanical vibrations to said radial support only, said mechanical vibrations being fed in a direction parallel to or at an angle not exceeding 10 degrees with the line of contact between said workpiece and said radial support;

whereby the frictional interaction between said driving member and said workpiece is maintained substantially without interference from said ultrasonic mechanical vibrations, while the forces of friction developed between said workpiece and said radial support are significantly reduced due to said ultrasonic mechanical vibrations fed thereto.

17. An arrangement for positioning and rotating a workpiece shaped like a body of rotation and having a plane face, the arrangement being used for workpiece machining and controlling dimensions and shape of the workpiece, said arrangement comprising:

a support system comprising a radial support for positioning said workpiece in a radial direction, and an axial support for positioning said workpiece in an axial direction;

frictional rotary driving means for engaging a portion of said workpiece;

an electromechanical converter operating within an ultrasonic range and including a waveguide adapted to directly feed mechanical vibrations only to said axial support;

said waveguide being arranged at an angle not exceeding 10 degrees with the line of contact between said workpiece and said axial support and being separated from said rotary support and said rotary driving means so that vibrations fed from said converter to said axial support are isolated from said rotary driving means whereby the vibrations have substantially no effect on the frictional engagement between the rotary driving means and the workpiece.

18. An arrangement as defined in claim 17, wherein said driving member is shaped like a roller with a resilient ring contacting with the workpiece peripheral surface.

19. An arrangement as defined in claim 18, wherein said resilient ring is provided with rims, the distance therebetween ensuring a negative clearance with respect to the workpiece width.

20. An arrangement as defined in claim 17, wherein said driving member is shaped like a roller having a resilient ring contacting with an outer facet of the workpiece.

21. An arrangement as defined in claim 17, wherein said driving member is shaped like a roller with a resilient ring having two collars contacting with both workpiece peripheral surface and its face.

22. A method for positioning and rotating a workpiece shaped like a body of rotation, the method being used during workpiece machining and controlling dimensions and shape of the workpiece, the method comprising the following steps:

positioning said workpiece on a support system comprising a stationary axial support and a radial support, thus ensuring the respective lines of contact between said workpiece and said supports;

engaging a surface of said workpiece with a rotary driving member;

bringing said workpiece into rotation by torque transmitted from said rotary driving member to said workpiece due to the forces of friction developed therebetween;

feeding ultrasonic mechanical vibrations only to said axial support, said ultrasonic mechanical vibrations being fed in a direction parallel to or at an angle not exceeding 10 degrees with the line of contact between said workpiece and said axial support;

whereby the frictional interaction between said driving member and said workpiece is maintained substantially without interference from said ultrasonic mechanical vibrations, while the forces of friction developed between said workpiece and said axial support are significantly reduced to said ultrasonic mechanical vibrations fed thereto.

* * * * *